US005813210A

United States Patent [19]

Musha et al.

[11] Patent Number: 5,813,210

[45] Date of Patent: Sep. 29, 1998

[54] TWISTING METHOD AND TWISTING FRAME UTILIZING I/F FLUCTUATIONS

[75] Inventors: Toshimitsu Musha, 13-17, Minami-Tsukushino 2-chome, Machida-shi, Tokyo, Japan; Yuichi Yanai, Okazaki, Japan; Kazuyoshi Muraoka, Osaka, Japan; Yuki Niwa; Yasuo Nakano, both of Okazaki, Japan

[73] Assignees: Toshimitsu Musha; Nisshinbo Industries Inc., both of Tokyo, Japan

[21] Appl. No.: 853,417

[22] Filed: May 9, 1997

Related U.S. Application Data

[63] Continuation of Ser. No. 396,227, Mar. 1, 1995, abandoned.

[51] Int. Cl.[6] ..... D01H 7/46

[52] U.S. Cl. ..... 57/264; 57/75; 57/315

[58] Field of Search ..... 57/264, 75, 314

[56] References Cited

U.S. PATENT DOCUMENTS

| | | | |
|---|---|---|---|
| 3,868,496 | 2/1975 | Pugh | 235/92 PE |
| 4,059,950 | 11/1977 | Negishi et al. | 57/140 |
| 4,102,117 | 7/1978 | Dornberger | 57/264 |
| 4,338,945 | 7/1982 | Kosdugi et al. | 128/421 |
| 4,922,703 | 5/1990 | Matsui et al. | 57/264 |
| 4,977,737 | 12/1990 | Yamada et al. | 57/97 |
| 5,400,582 | 3/1995 | Hartmeier et al. | 57/264 |
| 5,570,725 | 11/1996 | Musha et al. | 139/192 |
| 5,598,875 | 2/1997 | Musha et al. | 139/192 |

OTHER PUBLICATIONS

"Bioinformation and 1/f Fluctuation", applied Physics, 1985, pp. 429–435. (Which corresponds to partial translation, Physics Of The Living State, Ohmasha, 1994).

"Biocontrol and /1f Fluctuation" Journal of Japan Society of Precision Machinery, 1984, vol. 50 No. 6. (Which corresponds to partial translation, Computer Analysis of cardiovascular signals Chapter 6 1/f fluctuations of the Biological Rhythm, *1/f Fluctuations of the Biological Rhythm*, IOS Press, 1995).

"The World of Fluctuations" by Kodansha Publisher (Which corresponds to partial translation, 1/f–Like fluctuations of Biological Rhythm, Musha, Brain Functions Laboratory, Japan).

"Seitai Shingo, Chapter 10, Biological Rhythm", Chapter 10, with a translation of section 2–4 in Chapter 10, (partial translation of Seitai Shingo, section 2–4 in Chapter 10), (Which corresponds to partial translation, Biological Signals—Actual Measurement and Analysis, Corona Publishing Co., Ltd.).

*Primary Examiner*—William Stryjewski

*Attorney, Agent, or Firm*—Nikaido, Marmelstein, Murray & Oram LLP

[57] ABSTRACT

A twisting frame 1, and a method of twisting yarn 11 in which a twist is applied to the yarn by signals having a 1/f fluctuation to yield a yarn 11 in which the yarn count varies with a 1/f fluctuation. The first aspect is a twisting method that applies twist to a single yarn or a plural number of yarns, in which a twist is applied to the yarn or yarns by setting the twist count to correspond to the strengths of serial signals having a 1/f fluctuation.

8 Claims, 2 Drawing Sheets

TWISTING METHOD AND TWISTING FRAME UTILIZING I/F FLUCTUATIONS

This application is a continuation of application Ser. No. 08/396,227 filed Mar. 1, 1995, now abandoned.

BACKGROUND OF THE INVENTION

This invention relates to twisting yarn in such a way that variations having a correlated fluctuation are imparted to the twist of the yarn.

In conventional processes of picking a single yarn and applying a twist to it, or twisting two or more yarns together (a throwing process), cam mechanisms and/or computers are used to create irregularities in the yarn. After this yarn is made into woven goods or knited goods, color density variations appear in the dyeing process, resulting in the appearance of uneven dyeing. Ring twisters, two-for-one twisters, Italian twisters, covering machines, false twisters, etc., can be used in this twisting method.

Conventional machine twisting produces a yarn with a natural, irregular feel by varying the twist of the yarn at random, but this randomness produces an artificial texture with very little natural feel, and is not very comfortable for the wearer.

OBJECTS AND SUMMARY OF THE INVENTION

The object of the present invention is to make a yarn available that provides a natural feeling of comfort to human beings.

This invention provides a method of manufacturing yarn on an industrial scale in which the twist of the yarn does not vary randomly, but rather the variations have a correlation, specifically, a 1/f fluctuation, and thus the yarn will have a natural feeling of unevenness. In this invention, "1/f fluctuation" is defined as a power spectrum with a frequency component f, proportional to $1/f^k$, where k is approximately 1. This invention embodies at least four aspects:

The first aspect is a twisting method that applies twist to a single yarn or a plural number of yarns, in which a twist is applied to the yarn or yarns by setting the twist count to correspond to the strengths of serial signals having a 1/f fluctuation.

The second aspect is a twisting frame that twists a single yarn or plural yarns, comprising of a feed roller that draws the yarn or yarns and a spindle that receives the yarn or yarns fed from the feed roller, wherein, a twist count having a 1/f fluctuation is applied to the yarn or yarns by setting the rotational speed of the feed roller to correspond to the strengths of serial signals having a 1/f fluctuation.

The third aspect is a twisting frame that twists a single yarn or plural yarns, comprising of a feed roller that draws the yarn or yarns and a spindle that receives the yarn or yarns fed from the feed roller, wherein, a twist count having a 1/f fluctuation is applied to the yarn or yarns by setting the rotational speed of the spindle to correspond to the strengths of serial signals having a 1/f fluctuation.

The fourth aspect is a twisting frame that twists a single yarn or plural yarns, comprising of a feed roller that draws the yarn or yarns and a spindle that receives the yarn or yarns fed from the feed roller, wherein, a twist count having a 1/f fluctuation is applied to the yarn or yarns by setting the rotational speed of both the feed roller and spindle to correspond to the strengths of serial signals having a 1/f fluctuation. This invention is effective as follows.

The twist of the yarn does not change randomly, rather the change has a correlation. Because this correlation has a 1/f fluctuation, it imparts a special feeling of comfort and aesthetic beauty to the wearer.

Woven goods or knited goods woven or knit using yarn to which a 1/f fluctuation has been imparted to the twist of the yarn also have a 1/f fluctuation. Thanks to the 1/f fluctuation in the twist, they are characterized by a particularly comfortable feel and, subsequent to dyeing, by color density variations, again imparting a special feeling of comfort and aesthetic beauty to the wearer.

Yarn with a hand-spun natural irregular feel can be manufactured at low cost on an industrial scale.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

A working example of this invention is explained below using the drawings.

This invention, when applying a twist to yarn 11, imparts changes having a 1/f fluctuation to this twist, thereby causing the twist of yarn 11 to have a 1/f fluctuation. As a result, the twist of yarn 11 will vary with a correlation having a 1/f fluctuation, making it possible to manufacture yarn in large quantities using mechanical equipment, yet having a feeling similar to yarn spun by hand. Further, spun yarn and/or filaments, etc., may be used for yarn 11.

Figure 1:
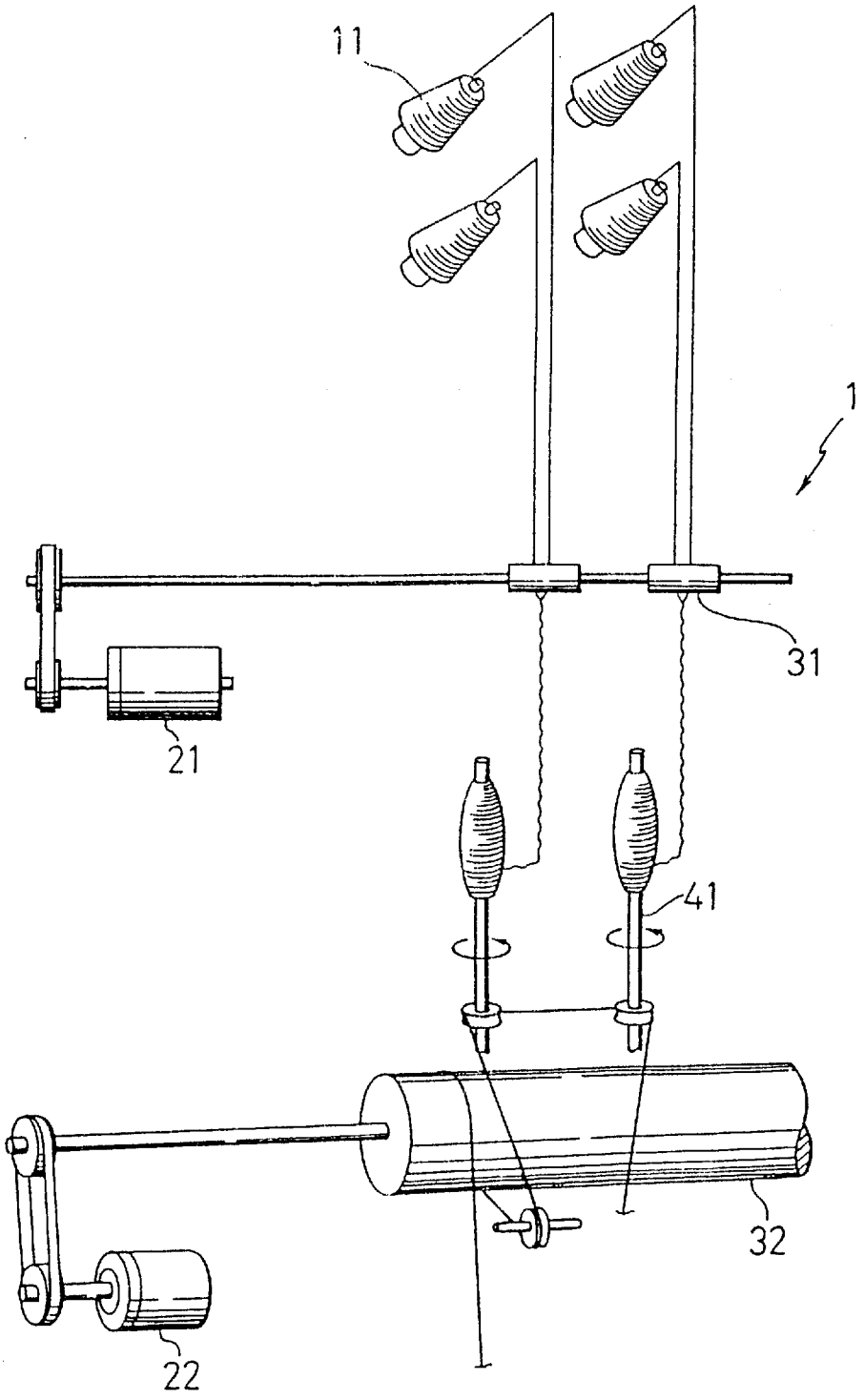
FIG. 1 shows an overview diagram of the principal components of a twisting frame according to the present invention.
Figure 2:
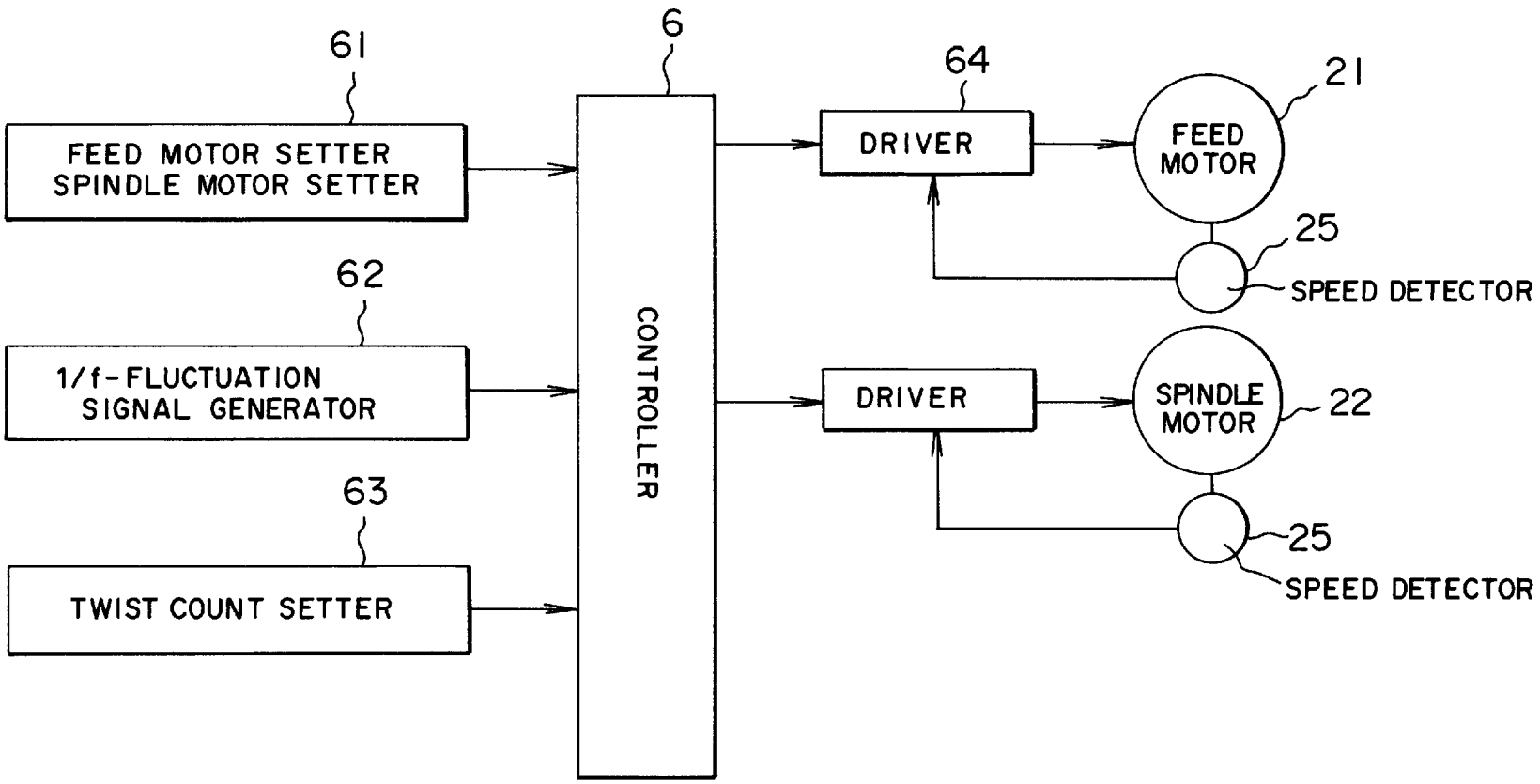
FIG. 2 is a block diagram of the drive system for the twisting frame motors.

The twisting frame 1 is a device to twist yarn by applying a twist to a single yarn or plural number of yarns 11. An example of a twisting frame 1 embodying this invention is shown in the simplified diagram in FIG. 1. It is provided with a plural number of motors, for example, feed motor 21, spindle motor 22, etc., each of which can be independently controlled by means such as shown in FIG. 2 and described below. Feed motor 21 is used to drive feed roller 31. For example, the rotational speed of feed roller 31 can be determined by imparting a prescribed rotational speed to feed roller 31 via belts and/or gears, and adjusting the size and number of gears. Also, an arbitrary rotational speed can be imparted to spindle 41 by rotating a drive roller 32 using spindle motor 22. These motors can also be operated in common where necessary, and the rotational speed of the rollers can be adjusted using converters such as belts and/or gears, etc.

Feed roller 31 has a prescribed rotational speed, and draws out a single yarn or plural yarns 11 together. Yarn 11 is drawn out by being pinched and rotated by feed roller 31. The drawing speed of yarn 11 is determined by the diameter and rotational speed of the feed roller 31.

The rotation of spindle 41 imparts a twist to yarn 11 fed from feed roller 31. Yarn 11 is subsequently wound onto bobbins. In reality, the degree of twist is set for the yarn to be able to withstand subsequent processes, generally, weaving, knitting, etc., and to affect the hand of finished woven fabrics, knitted goods, etc. The degree of twist can be expressed by a twist coefficient as shown in Equation 1.

$$K = \frac{T}{\sqrt{Ne}} \quad \text{Equation 1}$$

where,

K is the twist coefficient,

T is the twist count, and Ne is the yarn count.

For yarns of the same yarn count, the twist count increases as the twist coefficient increases, forming yarn with a hard hand. The twist count decreases as the twist coefficient decreases, forming a bulky yarn with soft hand. In a general case, the twist coefficient will be 2.5–4.5. To obtain yarns of the same hand but with different yarn counts the twist coefficient is set to be constant, and the twist count is set to correspond to the yarn count. The twist is determined by the length of the yarn fed from feed roller 31 and by the number of twists imparted over that length. Therefore, the twist can be modified by keeping either parameter constant and varying the other. To increase the twist at the same yarn count, the feed from feed roller 31 can be kept constant while increasing the rotation of spindle 41; or the rotation of spindle 41 can be kept constant while reducing the feed from feed roller 31. The same result will be achieved in either case.

The present inventor was the first in the world to discover that a 1/f fluctuation would impart a particularly comfortable feel to humans. The results were published in a paper entitled "Bioinformation and 1/f Fluctuation," Applied *Physics,* 1985, pp. 427–435, and in another paper titled "Biocontrol and 1/f Fluctuation," *Journal of Japan. Soc. of Precision Machinery,* 1984, Vol. 50 No. 6. The abstract of these papers read, "A 1/f fluctuation provides a comfortable feeling to humans, the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore, a 1/f fluctuation is a fluctuation of the right proportion between these two extremes".

In addition, an excerpt from "The World of Fluctuations", published by Kodansha publisher, reads "For example, the rhythms exhibited by the human body such as heart beats, hand-clapping to music, impulse-release period of neurons, and alpha rhythms observed in the brain, are all basically 1/f fluctuations, and it has been shown experimentally that if a body is stimulated by a fluctuation like these biorhythmic 1/f fluctuations, it would feel comfortable." Fluctuations (variations) exist in various forms throughout the nature, but the mumur of a brook, breath of wind, and other phenomena that impart a comfortable feeling to humans have a 1/f fluctuation, while typhoons and other strong winds that evoke a sense of uneasiness do not have this 1/f fluctuation.

FIG. 2 is a block diagram to illustrate the motor controls. Signals from feed-motor speed and spindle-motor speed setter 61, 1/f-fluctuation signal generator 62, and twist count setter 63 for the yarn 11, are processed by controller 6. Controller is connected to drivers 64 which control each motor. Each motor supplies feedback via speed detectors 25, allowing their rotational speed to be controlled. Motor speed setters 61 set the speed of each motor to a prescribed value. By imparting a 1/f-fluctuation signal from 1/f-fluctuation signal generator 62 based on these prescribed speed values, a 1/f-fluctuation can be imparted to the rotational speed of the motors. In addition, if the number of twists of yarn 11 is set using twist count setter 63 of yarn 11, a yarn 11 having a 1/f fluctuation based on this twist count will be spun.

The 1/f fluctuation signal is determined from $Y_1, Y_2, Y_3, \ldots$ generated by multiplying n coefficients, $a_1, a_2, a_3 \ldots a_n$, on numbers, $x_1, x_2, x_3 \ldots$ Generally, $y_j$ can be expressed by Equation 2. Here, the sequence of numerical values forming $Y_1, Y_2, Y_3, \ldots$ has a 1/f spectrum. (For further details, refer to *Seitai shingô* [*Biological Signaling*], Chapter 10, "Biological Rhythms and Fluctuations," published by Corona Publishers, Ltd.)

$$y_j = x_j + \left(\frac{1}{2}\right) x_{j-1} + \left(\frac{1 * 3}{2^2 * 2!}\right) x_{j-2} + \left(\frac{1 * 3 * 5}{2^3 * 3!}\right) x_{j-3} + \ldots \left(\frac{1 * 3 * 5 * \ldots * (2n-1)}{2^{n-1} * (n-1)!}\right) x_{j-n+1} \quad \text{Equation 2}$$

In the 1/f fluctuation signal generator 62 shown in FIG. 2, step I generates a sequence of random numbers, x, using, for example, a computer. In step 2, this sequence of random numbers is stored in a storage device, where a certain number, n, of coefficients, a, are successively multiplied on the random numbers, and then, by a linear transformation, a sequence of numerical values, y, is obtained. This numerical sequence, y, has a 1/f spectrum, and hence is converted into electrical signals as a 1/f fluctuation signal and output as the motor control signal. For example, large values in the numerical sequence can be set to correspond to a high electric potential to increase the speed of the motors, thereby creating a larger number of twists. Other methods can also be employed, such as numerical control to control the rotational frequency of the motors using values from the numerical sequence. And if, for example, the inertia of the motors and other components of the control system of twisting frame 1 is large, twist can also be applied by reducing the level of the 1/f fluctuation control signal as necessary.

As a method of imparting a 1/f fluctuation to yarn 11, the twist can be made to vary by setting the spindle rotation to be constant and controlling feed motor 21. For example, if a 1/f fluctuation is imparted to the speed at which yarn 11 is taken up by feed roller 31, the twist of yarn 11 will vary between tight and loose, and this variation will have the characteristics of a 1/f fluctuation. The take-up speed of this feed roller 31 can be adjusted by controlling the rotational speed of feed motor 21. Therefore, by applying a 1/f fluctuation signal to the rotational speed of feed motor 21 and using the rotation of spindle 41 to change the twist of yarn 11, a 1/f fluctuation is applied to the twist of yarn 11. On the other hand, a twist varying with a 1/f fluctuation can also be applied to yarn 11 by keeping the rotation of feed roller 31 constant and applying a 1/f fluctuation signal to the rotational control of spindle motor 22. It is also possible to apply a 1/f fluctuation by controlling both motors concurrently.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A twisting method comprising generating serial signals having a 1/f fluctuation, setting a twist count to correspond to the strengths of said serial signals having 1/f fluctuation, and applying twist to a single yarn using said twist count producing a twisted single yarn having 1/f fluctuations therein to give a particularly comfortable feel to a subsequently produced product.

2. A twisting frame that twists a single yarn producing a twisted single yarn having 1f fluctuations therein, comprising a feed roller that draws said yarn, a spindle that receives said yarn fed from said feed roller, and means for setting the rotational speed of said feed roller to correspond to the strengths of serial signals having a 1/f fluctuation whereby a twist count having a 1/f fluctuation is applied to said yarn to give a particularly comfortable feel to a subsequently produced product.

3. A twisting frame that twists a single yarn producing a twisted single yarn having 1f fluctuations therein, comprising a feed roller that draws said yarn, a spindle that receives said yarn fed from said feed roller, and means for setting the rotational speed of said spindle to correspond to the strengths of serial signals having a 1/f fluctuation whereby a twist count having a 1f fluctuation is applied to said yarn to give a particularly comfortable feel to a subsequently produced product.

4. A twisting frame that twists a single yarn producing a twisted single yarn having 1f fluctuations therein, comprising a feed roller that draws said yarn, a spindle that receives said yarn fed from said feed roller, and means for setting the rotational speed of said feed roller and spindle to correspond to the strengths of serial signals having a 1/f fluctuation whereby a twist count having a 1/f fluctuation is applied to said yarn to give a particularly comfortable feel to a subsequently produced product.

5. A twisting method comprising generating serial signals having a 1/f fluctuation, setting a twist count to correspond to the strengths of said serial signals having 1/f fluctuation, and applying twist to a plural number of yarns using said twist count producing twisted yarns having 1/f fluctuations therein to give a particularly comfortable feel to a subsequently produced product.

6. A twisting frame that twists a plural number of yarns producing twisted yarns having 1/f fluctuations therein, comprising a feed roller that draws said yarns, a spindle that receives said yarns fed from said feed roller and means for setting the rotational speed of said roller to correspond to the strengths of serial signals having a 1/f fluctuation whereby a twist count having a 1/f fluctuation is applied to said yarns to give a particularly comfortable feel to a subsequently produced product.

7. A twisting frame that twists a plural number of yarns producing twisted yarns having 1/f fluctuations therein, comprising a feed roller that draws said yarns, a spindle that receives said yarns fed from said feed roller, and, means for setting the rotational speed of said spindle to correspond to the strengths of serial signals having a 1/f fluctuation whereby a twist count having a 1/f fluctuation is applied to said yarns to give a particularly comfortable feel to a subsequently produced product.

8. A twisting frame that twists a plural number of yarns producing twisted yarns having 1/f fluctuations therein, comprising of a feed roller that draws said yarns, a spindle that receives said yarns fed from said feed roller, means for setting the rotational speed of said feed roller and spindle to correspond to the strengths of serial signals having a 1/f fluctuation whereby a twist count having a 1/f fluctuation is applied to said yarns to give a particularly comfortable feel to a subsequently produced product.

* * * * *